US007441582B2

(12) United States Patent
Lukos

(10) Patent No.: US 7,441,582 B2
(45) Date of Patent: Oct. 28, 2008

(54) ANTI-BOW ROLLER TUBE HOUSING ASSEMBLY

(76) Inventor: Stephen Lukos, 1879 Litchfield Rd., Watertown, CT (US) 06795

( * ) Notice: Subject to any disclaimer, the term of this patent is extended or adjusted under 35 U.S.C. 154(b) by 143 days.

(21) Appl. No.: 10/943,522

(22) Filed: Sep. 17, 2004

(65) Prior Publication Data

US 2006/0060306 A1 Mar. 23, 2006

(51) Int. Cl.
*E06B 9/08* (2006.01)

(52) U.S. Cl. ..... 160/23.1; 160/242; 242/595

(58) Field of Classification Search ..... 160/22, 160/23.1, 24, 29, 38, 66, 242, 903; 242/595; 248/266, 267, 273

See application file for complete search history.

(56) References Cited

U.S. PATENT DOCUMENTS

| | | | | |
|---|---|---|---|---|
| 3,900,063 | A | 8/1975 | Roller et al. | |
| 4,223,714 | A | 9/1980 | Weinreich et al. | |
| 4,323,105 | A | 4/1982 | Berman et al. | |
| 4,344,474 | A | 8/1982 | Berman | |
| RE31,793 | E | 1/1985 | Berman et al. | |
| 4,784,204 | A * | 11/1988 | Lohausen | 160/22 |
| 5,133,397 | A | 7/1992 | Lohausen | |
| 5,230,377 | A | 7/1993 | Berman | |
| 5,285,837 | A | 2/1994 | Pozzi | |
| 5,333,663 | A | 8/1994 | Eger | |
| D355,587 | S | 2/1995 | Pozzi | |
| 5,673,739 | A * | 10/1997 | Brutsaert | 160/22 |
| 6,024,152 | A * | 2/2000 | Rosenich | 160/22 |
| 6,164,428 | A | 12/2000 | Berman et al. | |
| 6,230,782 | B1 * | 5/2001 | Reichert | 160/32 |
| 6,402,110 | B1 | 6/2002 | Berman et al. | |
| 6,478,070 | B2 * | 11/2002 | Poppema | 160/23.1 |
| 6,557,303 | B2 * | 5/2003 | Finke et al. | 49/409 |
| 6,817,399 | B2 | 11/2004 | Berman et al. | |
| 7,134,473 | B2 * | 11/2006 | Lukos | 160/242 |
| 2006/0060313 | A1 * | 3/2006 | Lukos | 160/242 |

FOREIGN PATENT DOCUMENTS

| | | |
|---|---|---|
| DE | 196 54 668 | 4/1998 |
| EP | 0 745 742 | 12/1996 |
| EP | 0 792 978 | 9/1997 |
| EP | 1 030 003 | 8/2000 |

* cited by examiner

*Primary Examiner*—Blair M. Johnson
(74) *Attorney, Agent, or Firm*—Lipsitz & McAllister, LLC

(57) ABSTRACT

A roller tube housing includes a first housing portion and a second housing portion configured to lockingly engage with the first housing portion defining an interior and an exterior. A support cradle can be formed integral with the first housing portion. The support cradle can be configured to support the roller tube along a length of the roller tube. A dispensing passage for dispensing material from said roller tube.

28 Claims, 3 Drawing Sheets

ANTI-BOW ROLLER TUBE HOUSING ASSEMBLY

BACKGROUND

The present invention relates to solar screens and awnings, and more particularly, to a housing assembly including an integral support cradle for a roller tube of a solar screen, awning or the like.

Conventional roller shade systems make use of flexible shades supported by elongated roller tubes. The roller tube, typically made from aluminum or steel, is rotatably supported and provides support for the flexible shade on the roller tube. Roller shades include manual shades having spring driven roller tubes and motorized shades having drive motors engaging the roller tube to rotatingly drive the tube. The drive motors for motorized shades include externally mounted motors engaging an end of the roller tube and internal motors that are received within an interior defined by the tube.

Conventional roller shades have support systems that engage the opposite ends of the roller tube to provide the rotatable support that is required for winding and unwinding of the flexible shade. The support system includes a drive end support assembly having a coupler engaging the open end of the tube for rotation. The coupler is adapted to receive the drive shaft of a motor such that rotation of the drive shaft is transferred to the coupler for rotation of the tube. The motor is secured to a bracket for attachment of the roller shade system to the wall or ceiling of a structure, for example. A coupler engaging an opposite end of the roller tube could receive a motor drive shaft or, alternatively, could receive a rotatably supported shaft of an idler assembly.

A roller shade tube supported in a conventional manner from the opposite ends will deflect in response to transverse loading, from the weight of an attached shade for example. The response of a roller tube, supported at its ends in a conventional manner, from the weight of a flexible shade as well as from self-weight of the tube, results in a downward "sagging" deflection in a central portion of the roller tube with respect to the supported ends.

For roller tubes having wider shades (e.g., widths of 10 to 30 feet or more), support of the correspondingly long roller tubes in a conventional manner can result in sagging deflection detrimental to the appearance of a supported shade. V-shaped wrinkles, also known as "smiles", can be formed in an unrolled shade supported by a sagging roller tube. Sagging deflection in a conventionally supported roller tube can also have a detrimental effect on shade operation. During winding of a shade, the shade is drawn onto the tube in a direction that is substantially perpendicular to the axis of the tube. Due to curvature along the length of a sagging tube, opposite end portions of a supported shade will tend to track towards the center portion of the tube as the shade is rolled onto the tube. Such uneven tracking of opposite end portions of the shade can cause the end portions to be wound more tightly onto the end portions of the roller tube than the central portion of the roller tube. As a result, the central portion of the shade is not pulled tightly to the tube causing it to tend to buckle. This buckling of the central portion of the shade, if severe enough, can create variations in radial dimensions of the rolled shade along the length of the tube, thereby impairing subsequent rolling of lower portions of the shade. Uneven tracking can also cause surface discontinuities, known as "golf balls," that include a permanent sagging pocket shaped discontinuity in the shade material.

The problem of sagging deflection in longer roller tubes has been addressed in prior art roller shades by increasing the diameter of the roller tube.

Although increase of the roller tube diameter serves to reduce sagging deflection in conventional end-supported tubes, there are undesirable consequences associated with such a solution. Increasing the diameter of the roller tube increases weight, thereby potentially affecting the size and type of structure capable of providing rotatable support for the tube. Also, additional space required by the larger diameter roller tube and its associated support structure may not be readily available in many installations. Even if space is available, the bulky nature of the system due to the required large roller tube diameter is often objectionable for aesthetic reasons.

Other prior art attempts at preventing sagging involve the use of center supports and/or elongate support rollers in a variety of configurations located below the rotational axis of the roller tube. The elongate support rollers add weight and complexity to the roller tube system. The increased costs and failure mechanisms inherent in the more complex support systems diminish the advantages provided.

It would be advantageous to provide a method and an apparatus to ensure that roller tube sagging is prevented without the added costs and complexity of the prior art systems. The present invention provides the aforementioned and other advantages.

What is needed in the art is a housing assembly having a fixed support cradle within the housing assembly.

SUMMARY

In accordance with the present invention, a roller tube housing includes a first housing portion and a second housing portion configured to lockingly engage with the first housing portion defining an interior and an exterior. A support cradle can be formed integral with the first housing portion. The support cradle can be configured to support the roller tube along a length of the roller tube. A dispensing passage can be formed for dispensing material from said roller tube.

In an exemplary embodiment, the first housing portion can couple with the second housing portion through insertion of an insert edge into a pivot element and engagement of a locking tab with a tang element. The first housing portion and the second housing portion can be configured to receive a coating proximate the interior, prior to assembly. The support cradle can be substantially crescent shaped in cross-section. A first mount can be configured to couple to an assembly of the first housing portion and the second housing portion proximate a first end. A second mount can be configured to couple to the assembly of the first housing portion and the second housing portion proximate a second end opposite the first end. The dispensing portion can be formable between the support cradle and the second housing portion and can be configured to pass a sheet material from the interior to the exterior.

In an exemplary embodiment, the first housing portion can include a first support wall having an upper boundary and a lower boundary opposite the upper boundary. A pivot element can be formed in the first support wall proximate the upper boundary. A locking tab can be formed in the first support wall proximate the upper boundary. The support cradle can be formed integral with the first support wall proximate the lower boundary. The second housing portion can include a second support wall with a top section adjacent a side section. An insert edge can be formed in the top section distal from the side section and can be configured rotatable in the pivot element. A tang element can be formed in the top section near the insert edge. The tang element can be configured to couple with the locking tab. The insert edge can be insertable in the pivot element. The locking tab can engage the tang element. The top section can include a mounting slot configured to couple to a mounting bracket. The mounting bracket can be configured to support the housing. The locking element and the top section can form an upper surface of the housing. The cradle can form a bottom of the housing opposite the top section. The first support wall can form a side of the housing between the upper boundary and the support cradle as well as, opposite the side section. The side section can form a side of the housing between the top section and the dispensing portion as well as, opposite the first support wall. The side section and the top section can be substantially orthogonal. The locking tab and the first support wall can be substantially orthogonal. The support cradle can extend substantially orthogonal from the first support wall.

An exemplary method of mounting a sheet material disposed on a roller tube in a housing can be provided by forming a first housing portion including a first support wall with an upper boundary and a lower boundary opposite the upper boundary. A pivot element and a locking tab can be formed in the first support wall proximate the upper boundary. A support cradle can be formed integral with one of the first and second housing portions. The method provides for forming a second housing portion having a second support wall with a top section adjacent a side section. An insert edge and a tang element can be formed in the top section distal from the side section. The method provides for coupling the first housing portion and the second housing portion and defining an interior and an exterior of the housing. The method can include supporting a roller tube and material disposed thereon along a length of the roller tube with the support cradle.

In an exemplary embodiment, the invention provides for inserting the insert edge into the pivot element and engaging the locking tab with the tang element. The method can include coating the first housing portion with a material prior to assembly of the first housing portion and the second housing portion. The method provides for mounting the housing to a mounting bracket proximate the top section, wherein the top section can include at least one mounting groove configured to receive fasteners. The method provides for forming a dispensing passage between the support cradle and the side section of the second housing distal from the top section. The method provides for the first housing portion and the second housing portion to be formable through extrusion processes. The method provides for the first housing portion and the second housing portion to include mounting grooves formed in the first support wall and the second support wall respectively. The method provides for attaching a first mount to an end of the housing. The method can include inserting the roller tube including sheet material disposed thereon in the interior of the housing and coupling to the first mount. The method can include attaching a second mount to the housing opposite the first mount. The method provides for coupling the roller tube to the second mount. The method provides for the support cradle to support the roller tube from beneath the roller tube. The method provides for the support cradle to be formed integral with the first support wall proximate the lower boundary.

BRIEF DESCRIPTION OF THE FIGURES

Referring now to the figures, wherein like elements are numbered alike.

DETAILED DESCRIPTION

The disclosure provides an exemplary roller tube housing. The roller tube housing can include a housing assembly including a first housing portion and a second housing portion configured to couple together in a locking fashion. The housing assembly can be configured to support a roller tube rotatably coupled to first and second mounts. The roller tube includes a body defining a length between a first end and a second end. The roller tube can be configured to support a sheet material wound around the roller tube body along the length of the body between the first and second ends of the body. A support cradle can be formed in the first housing portion of the housing assembly and extend between the first and second mounts. The support cradle can be configured to support the roller tube along the length of the roller tube.

Figure 1:
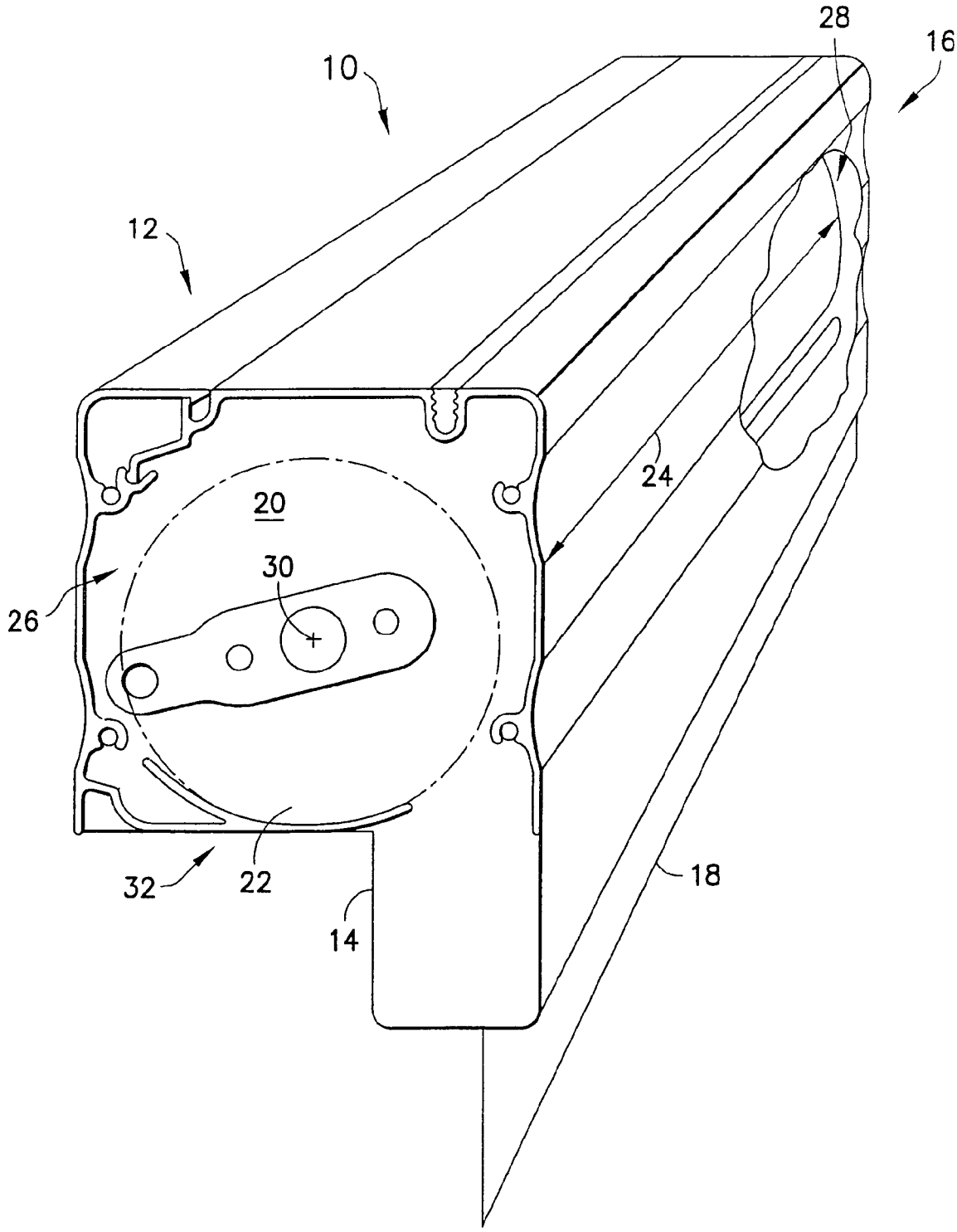
FIG. 1 is a perspective view of an exemplary roller tube housing.
Figure 2:
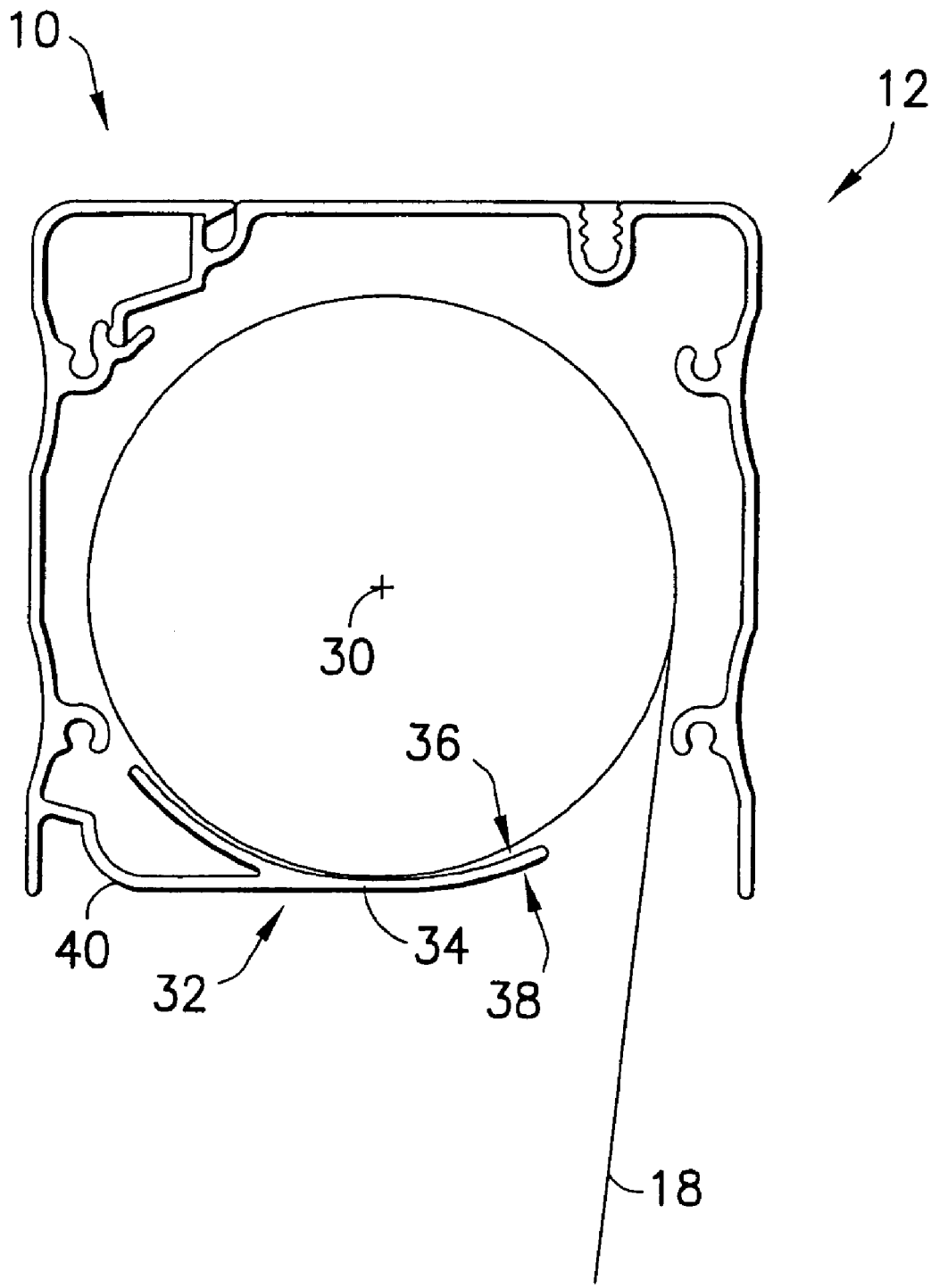
FIG. 2 is a side view of an exemplary roller tube housing when assembled.
Figure 3:
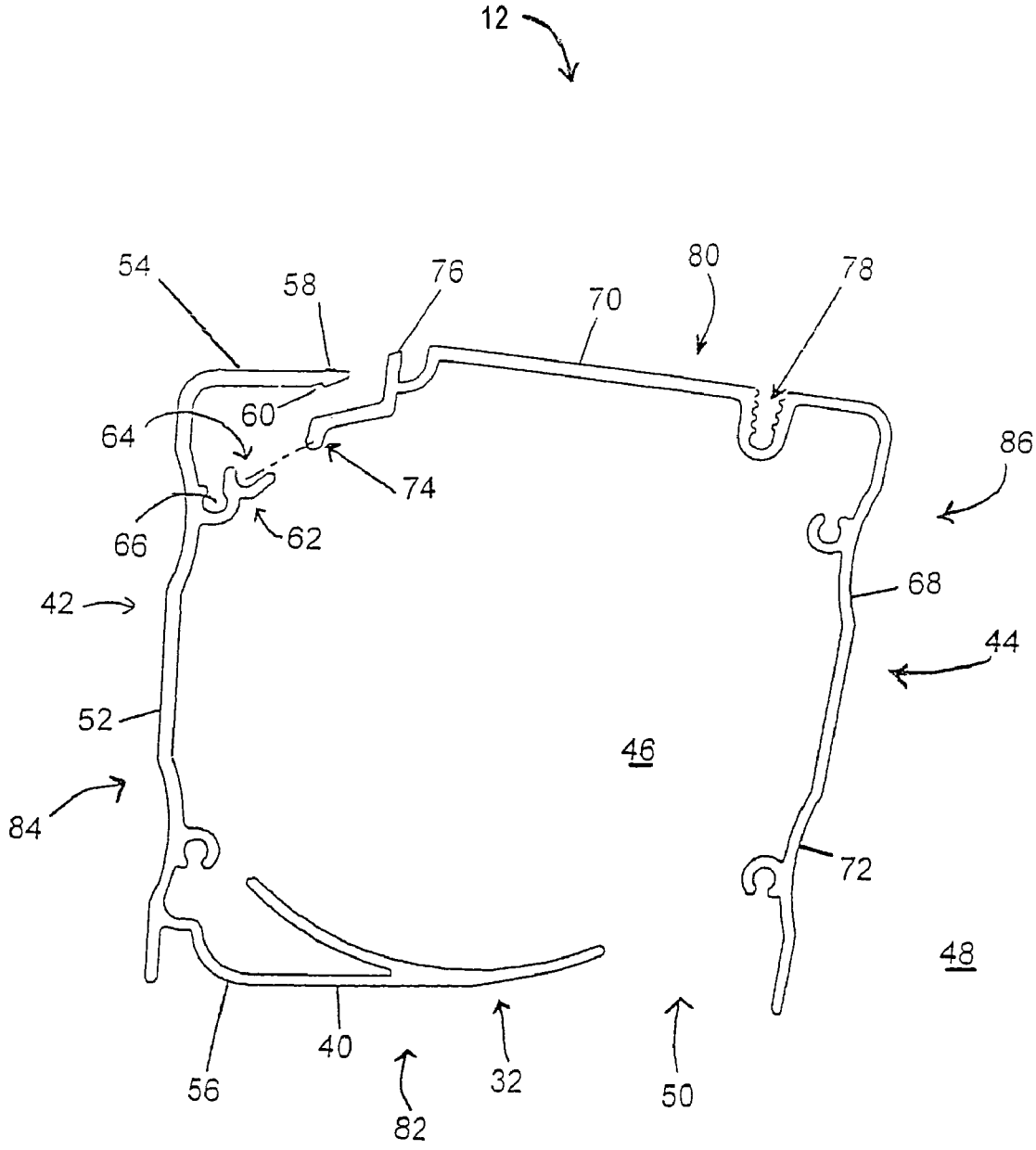
FIG. 3 is a side cross-sectional view of an exemplary roller tube housing before assembly.

FIGS. 1 through 3 illustrate exemplary embodiments of the roller tube housing 10. The roller tube housing 10 includes a housing assembly 12 that extends laterally between a first mount 14 and a second mount 16 opposite the first mount 14. The housing assembly 12 can be mounted on a wall, ceiling, or the like, to provide a stable position to deploy a sheet material 18. The housing assembly 12 can be constructed of a rigid material through various means including, for example, extruded aluminum, and the like.

A roller tube 20 is rotatably mounted in the housing assembly 12. The roller tube 20 can be pivotably supported on the first mount 14 and second mount 16. The roller tube 20 includes a body 22 that extends along a length 24 between a first end 26 and a second end 28. The roller tube body 22 can have a cylindrical shape including a circular cross-section extending along the length 24. The roller tube 20 is configured to support the sheet material 18, such as solar screen material. The sheet material 18 can be wound around the roller tube 20 about an axis of rotation (axis) 30 of the roller tube 20. As the sheet material 18 is wound (wrapped) around the roller tube body 22, the diameter of the roller tube 20 and sheet material 18 increases. As the sheet material is unwound, the diameter of the roller tube 20 and sheet material 18 decreases.

A support cradle 32 is coupled to the housing assembly 12. The support cradle 32 extends between the first mount 14 and the second mount 16. The support cradle 32 is configured to support the roller tube 20 and sheet material 18 wound thereon. More specifically, the support cradle 32 supports the roller tube 20 along the entire length 24 of the roller tube 20. The roller tube 20 is prevented from bowing along the length 24 due to the support from the support cradle 32. In an exemplary embodiment, the support cradle 32 can comprise a portion of the housing assembly 12. In another embodiment, the support cradle 32 can be formed separate from the housing assembly 12 and coupled to the housing assembly 12.

The support cradle 32 is positioned such that the roller tube 20 and sheet material 18 rest on top of the support cradle 32. The support cradle 32 can be positioned such that an upper surface 36 contacts the sheet material near a lower portion of the roller tube 20 below the axis 30. The support cradle 32 can support the roller tube 20 and sheet material 18 throughout the winding and unwinding of the sheet material 18 during which the outer diameter of the sheet material 18 on the roller tube 20 varies.

The support cradle 32 comprises a base 34 including the upper surface 36 and a lower surface 38. The base 34 can be formed into an elongate arcuate beam cupped to support the arcuate shape of the outer diameter of the roller 20 and sheet material 18 wrapped on the roller 20. The base 34 can include a width that extends outward a distance sufficient to support the roller 20 without snagging or binding to roller 20. In another exemplary embodiment, the base 34 can include a width approximately the size of a quarter of the outer perimeter of the roller 20 and sheet material 18 thereon. A coupling arm 40 can extend from the lower surface 38 and couple to the housing assembly 12. In a preferred embodiment, the base 34 can have a crescent shaped cross-section. In another embodiment, the base 34 can be a circular cross-section, or the like. The shape of the support cradle 32 can substantially mate to the shape of the roller tube 20 and sheet material 18. In a preferred exemplary embodiment, the upper surface can include a coating (not shown) that enables the sheet material 18 to slide across the support cradle upper surface 36 without sticking, being marked, or discolored. Preferably, the upper surface 36 is coated (e.g., painted) to prevent the surfaces of the sheet material 18 from being marked (e.g., by aluminum oxide) as the material 18 unwinds. Alternatively, the support cradle may be manufactured using material such as, high-density polyurethane, PVC, or the like. The support cradle 32 is rigid and does not move relative to the roller tube 20 sheet material 18 or housing assembly 12. The support cradle 32 can extend the entire length 24 of the roller tube 20 in a preferred embodiment. It is also contemplated that the support cradle 32 can extend substantially the length 24 of the roller tube 20 and variations thereof. In an exemplary embodiment, the support cradle 32 can be integrally formed from the housing assembly 12. The support cradle 32 can extend in a single contiguous length. In another embodiment, the support cradle 32 can include segmentation and discontinuities along the length and/or the width of the base 34. The support cradle 32 prevents the roller tube 20 from deflecting along the length 24 and resultantly prevents surface discontinuities from forming in the sheet material 18 as the sheet material 18 is dispensed out of the housing assembly 12.

Referring to FIG. 3, an exemplary roller tube housing 10 is illustrated in a cross-sectional side view. The housing assembly 12 can be arranged in a "two-piece" configuration as shown in FIG. 3 partially disassembled. A first housing portion 42 and a second housing portion 44 can couple together in a locking fashion to define an interior 46 and an exterior 48 of the housing assembly 12. The first housing portion 42 includes the support cradle 32. When the first housing portion 42 and second housing portion 44 are combined a dispensing passage or (dispensing portion) 50 is formed near the support cradle 32. The sheet material 18 can be dispensed from the dispensing passage 50.

The first housing portion 42 includes a first support wall 52. The first support wall 52 forms an upper boundary 54 and a lower boundary 56 opposite each other. The upper boundary 54 can extend substantially orthogonal from the plane of the first support wall 52. The lower boundary 56 can support the support cradle 32 and be formed integrally with the coupling arm 40. The lower boundary 56 can extend from the first support wall substantially orthogonal from the plane of the first support wall 52. A locking tab 58 can be formed proximate the upper boundary 54 of the first support wall 52. The locking tab 58 can be configured with a notch 60 in the upper boundary 54 of the first support wall 52. A pivot element 62 can be formed in the first support wall 52 near the upper boundary 54 and extending into the interior 46. The pivot element 62 can be formed as a finger-like element that includes a grooved portion 64. The pivot element 62 can also include a fastener receiver 66 formed into the pivot element 62. Other fastener receivers 66 can be formed in the first support wall 52 proximate the interior 46.

The second housing portion 44 can include a second support wall 68 having a top section 70 and a side section 72 adjacent the top section 70. In an exemplary embodiment, the top section 70 and side section 72 can be aligned substantially orthogonal. The top section 70 can include an insert edge 74 formed distal from the side section 72. The insert edge 74 is configured to be rotatable and insertable in the pivot element 62. Particularly, the insert edge 74 can be inserted into the grooved portion 64 of the pivot element 62. A tang element 76 can be formed in the top section 70 of the second support wall 68. The tang element 76 can be a protrusion extending from the top section 70 near the insert edge 74. The tang element 76 can extend toward the exterior 48. The tang element 76 is configured to couple with the locking tab 58 of the first support wall 52. Particularly, the protrusion of the tang element 76 is insertable into the notch 60 of the locking tab 58 such that the locking tab 58 engages the tang element 76. In an exemplary embodiment, the first housing portion 42 couples with the second housing portion 44 through the insertion of the insert edge 74 into the pivot element 62 and the engagement of the locking tab 58 with the tang element 76.

The top section 70 includes a mounting slot 78 formed in the second support wall 72. The mounting slot 78 can be formed in the second support wall 72 and can include ridges that threadably receive fasteners (not shown). The mounting slot 78 can be configured to couple to mounting brackets that support the housing assembly 12.

The assembled housing assembly 12 includes an upper surface 80. The upper surface 78 can be formed by the locking element 58 and the top section 70. The mounting slot 78 can be formed proximate the upper surface 80. The housing assembly 12 also includes a bottom 82 formed by the support cradle 32 and located opposite the upper surface 80. The support cradle 32 is located opposite the top section 70 when the housing assembly 12 is assembled. A first side 84 of the housing assembly 12 can be formed by a portion of the first support wall 52 between the upper boundary 54 and the lower boundary 56. The first side 84 can be between the upper surface 80 and the bottom 82 in the housing assembly 12. A second side 86 of the housing assembly 12 can be formed by the second support wall 68 between the upper surface 80 and the dispensing passage 50 and opposite the first side 84 of the housing assembly 12. In an exemplary embodiment, the housing assembly 12 forms a substantially rectilinear cross-section with a gap formed near the bottom 82 for the dispensing passage 50.

The exemplary roller tube housing disclosed herein provides the advantage of supporting the roller tube without the need for complex moving parts. The roller tube and sheet material wrapped around the roller tube can be supported along the entire length. The problem of bowing and sagging across the roller tube and the resultant smile-shaped surface discontinuities on the sheet material are prevented as a result of the novel support mechanism. Further advantages of the disclosed roller tube housing include the support cradle and housing assembly being formed integral improving strength, lowering weight and manufacturing costs. The novel housing assembly and support cradle allow for an application of paint to the support cradle prior to assembly, especially on the upper surfaces of the support cradle, thus preventing any marking on the sheet material. The housing assembly allows for a snap tight fit between first and second housing portions with the simple two-piece assembly. Moreover, a reduced diameter roller tube can be used, since the sheet material and roller tube are supported over the length of the roller tube, enabling a solar screen system to significantly reduce the size required to house the roller tube, as compared to prior art systems. For example, an awning/solar screen housing provided by the present invention may be only about 3 inches by 3 inches in cross-section for a given size awning/solar screen, whereas the prior art devices require larger diameter roller tubes for the same size awning/solar screen and are typically about 8 inches by 8 inches or greater in cross-section.

While the present invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A roller tube housing including a roller tube with an axis of rotation and sheet material comprising:

an elongate first housing portion having a side wall and a generally planar bottom wall cantilevered from said side wall, said cantilevered bottom wall carrying a support cradle coextensive therewith, said cradle being integral with said bottom wall;

an elongate second housing portion having a side wall and a generally planar top wall configured to snap fit and lockingly engage with said first housing portion to provide a housing with an interior and a generally rectangular exterior cross-section;

said support cradle being generally crescent shaped and having at least a portion that is elevated above said bottom wall, said support cradle being configured to support said roller tube from underneath the roller tube and at least partly directly below said axis of rotation throughout the winding and unwinding of said sheet material around the roller tube, during which an outer diameter of the sheet material on the roller tube varies; and a gap between the side wall of said second housing portion and an end of said cantilevered bottom wall farthest from said first housing portion side wall, said gap forming a dispensing passage for dispensing material from said roller tube.

2. The roller tube housing of claim 1 wherein said first housing portion couples with said second housing portion through insertion of an insert edge into a pivot element and engagement of a locking tab with a tang element.

3. The roller tube housing of claim 1 wherein said first housing portion and said second housing portion are configured to receive a coating proximate said interior prior to assembly.

4. The roller tube housing of claim 1 wherein said support cradle is substantially crescent shaped in cross-section.

5. The roller tube housing of claim 1 further comprising:

a first mount configured to couple to an assembly of said first housing portion and said second housing portion proximate a first end; and a second mount configured to couple to the assembly of said first housing portion and said second housing portion proximate a second end opposite said first end.

6. The roller tube housing of claim 1 wherein said housing has a generally square exterior cross-section.

7. The roller tube housing of claim 1 wherein the first housing portion comprises:

a pivot element formed in said side wall proximate an upper boundary of the side wall; and a locking tab formed in said side wall proximate said upper boundary.

8. The roller tube housing of claim 7 wherein said second housing portion further comprises:

an insert edge formed in said top wall distal from the second housing portion side wall, said insert edge being rotatable in said pivot element; and a tang element formed in said top wall near said insert edge, said tang element configured to couple with said locking tab.

9. The roller tube housing of claim 8 wherein said insert edge is insertable in said pivot element.

10. The roller tube housing of claim 8 wherein said locking tab engages said tang element.

11. The roller tube housing of claim 7 further comprising a mounting slot configured to couple to a mounting bracket, said mounting bracket configured to support said housing.

12. The roller tube housing of claim 7 wherein said locking tab and said top wall form an upper surface of said housing.

13. The roller tube housing of claim 7 wherein said support cradle forms a bottom of said housing opposite said top wall.

14. The roller tube housing of claim 7 wherein said first housing portion side wall forms a side of said housing between said upper boundary and said support cradle and opposite said second housing portion side wall.

15. The roller tube housing of claim 7 wherein said second housing portion side wall forms a side of said housing between said top wall and said dispensing passage and opposite said first housing portion side wall.

16. The roller tube housing of claim 7 wherein said side walls and said top wall are substantially orthogonal.

17. The roller tube housing of claim 7 wherein said locking tab and said first housing portion side wall are substantially orthogonal.

18. The roller tube housing of claim 7 wherein said support cradle extends substantially orthogonal from said first housing portion side wall.

19. A method of mounting a sheet material disposed on a roller tube having an axis of rotation in a housing comprising:

forming an elongate first housing portion including a first support wall with an upper boundary and a lower boundary opposite said upper boundary, a pivot element and a locking tab formed in said first support wall proximate said upper boundary;

forming an elongate second housing portion having a second support wall with a top section adjacent a side section, an insert edge and a tang element formed in said top section distal from said side section;

providing an elongate bottom wall extending from and substantially orthogonal to one of said first and second support walls, said bottom wall having a generally crescent shaped support cradle formed integrally and coextensive therewith, at least a portion of the support cradle being elevated above said bottom wall;

coupling said first housing portion and said second housing portion such that a dispensing passage is formed between a free end of said bottom wall and the support wall of the housing portion from which the bottom wall does not extend; and supporting said roller tube and material disposed thereon along a length of said roller tube with said support cradle, said support cradle supporting said roller tube from underneath said roller tube and at least partly directly below said axis of rotation throughout the winding and unwinding of sheet material around the roller tube, during which an outer diameter of the sheet material on the roller tube varies.

20. The method of claim 19 further comprising:

inserting said insert edge into said pivot element; and engaging said locking tab with said tang element.

21. The method of claim 19 further comprising:

coating said first housing portion with a material prior to assembly of said first housing portion and said second housing portion.

22. The method of claim 19 wherein said dispensing passage is formed between said support cradle and said side section of said second housing distal from said top section.

23. The method of claim 19 wherein said first housing portion and said second housing portion are formable through extrusion processes.

24. The method of claim 19 wherein said first housing portion and said second housing portion include mounting grooves formed in said first support wall and said second support wall respectively.

25. The method of claim 19 further comprising:

attaching a first mount to an end of said housing;

inserting said roller tube including sheet material disposed thereon in an interior of said housing and coupling to said first mount;

attaching a second mount to said housing opposite said first mount; and coupling said roller tube to said second mount.

26. The method of claim 19 wherein said support cradle supports said roller tube from beneath said roller tube.

27. The method of claim 19 wherein said support cradle only extends around a portion of the roller tube circumference.

28. A roller tube housing including a roller tube having an axis of rotation and sheet material comprising:

an elongate first housing portion having a first support wall including an upper boundary and a lower boundary opposite said upper boundary;

a pivot element formed in said first support wall proximate said upper boundary;

a locking tab formed in said first support wall proximate said upper boundary;

an elongate generally planar bottom wall formed integral with said first support wall proximate said lower boundary and having a support cradle integral and coextensive therewith, said support cradle being generally crescent shaped and having at least a portion that is elevated above said bottom wall, said support cradle being adapted to support a roller tube from underneath said roller tube and at least partly directly below said axis of rotation throughout the winding and unwinding of sheet material around the roller tube, during which an outer diameter of the sheet material on the roller tube varies;

an elongate second housing portion having a second support wall including a generally planar top section adjacent a side section;

an insert edge formed in said top section distal from said side section configured to be rotatable in said pivot element;

a tang element formed in said top section near said insert edge, said tang element configured to snap fit with said locking tab; and a dispensing passage formable between said support cradle and said side section of said second housing distal from said top section.

* * * * *